US006880595B2

(12) United States Patent
Nuss

(10) Patent No.: US 6,880,595 B2
(45) Date of Patent: Apr. 19, 2005

(54) APPARATUS FOR ADJUSTABLY POSITIONING A POWER TOOL OVER A WORK SURFACE

(76) Inventor: Bart A. Nuss, 2408 Running Brook Trail, Fisherville, KY (US) 40023

( * ) Notice: Subject to any disclaimer, the term of this patent is extended or adjusted under 35 U.S.C. 154(b) by 86 days.

(21) Appl. No.: 10/377,326

(22) Filed: Feb. 28, 2003

(65) Prior Publication Data

US 2003/0136466 A1 Jul. 24, 2003

Related U.S. Application Data

(63) Continuation of application No. 09/972,498, filed on Oct. 5, 2001, now Pat. No. 6,539,992.

(51) Int. Cl.[7] ..... B27C 5/00; B27C 9/00

(52) U.S. Cl. ..... 144/135.2; 144/135.3; 144/136.1; 144/136.95; 83/471.3; 83/473; 408/236; 408/237

(58) Field of Search ..... 144/1.1, 2.1, 35.2, 144/48.6, 134.1, 135.2, 135.3, 136.1, 137, 92, 103, 365, 371, 136.95, 154.1; 83/471.2, 471.3, 473, 486.1, 701; 408/90, 135, 236, 237, 712; 409/216, 230

(56) References Cited

U.S. PATENT DOCUMENTS

| | | | |
|---|---|---|---|
| 1,674,669 | A | 6/1928 | Stedman |
| 1,850,773 | A | 3/1932 | Rueger |
| 2,341,061 | A | 2/1944 | Rhodes et al. |
| 2,587,520 | A | 2/1952 | Peplow |
| 2,627,880 | A | 2/1953 | Johnson |
| 2,856,799 | A | 10/1958 | DeCurtis |
| 3,858,630 | A | 1/1975 | Cherry et al. |
| 3,923,086 | A | 12/1975 | Spohn, Jr. |
| 4,187,601 | A | 2/1980 | Aldrin |
| 4,349,301 | A | 9/1982 | Boyajian |
| 4,454,898 | A | 6/1984 | Pavnica |
| 4,463,785 | A | 8/1984 | Goeken |
| 4,484,608 | A | 11/1984 | Ferdinand et al. |
| 5,193,595 | A | 3/1993 | Johnson et al. |
| 5,287,900 | A | 2/1994 | Falco |
| 5,299,609 | A | 4/1994 | Wedler |
| 6,539,992 | B1 | 4/2003 | Nuss |
| 2003/0136466 | A1 | 7/2003 | Nuss |

*Primary Examiner*—Allen Ostrager
*Assistant Examiner*—Shelley Self
(74) *Attorney, Agent, or Firm*—Theresa Fritz Camoriano; Guillermo Camoriano; Camoriano and Associates

(57) ABSTRACT

A radial overarm router includes a machine base with a work surface, a vertical column, a bearing housing, a slide assembly, and a carriage subassembly. The bearing housing is mounted to, and may rotate about, the vertical column. The slide assembly mounts to the bearing housing and in combination with the bearing housing, the slide assembly has transnational and rotational motion relative to the column. The slide assembly includes a carriage subassembly that houses a router. The carriage subassembly is configured to allow pivotal and vertical or plunge type motion of the router. The carriage subassembly further provides for transverse movement of the router. Locking knobs and adjustable limit stops are provided for all directions of movement. All of these motions may be fixed by the locking knobs to use the router in a stationary position; or any combination of the motions may be employed to perform a variety of routing and shaping operations including rabbets, dados, stopped grooving and slots, pockets, mortises, tenons, and curved moldings.

22 Claims, 3 Drawing Sheets

APPARATUS FOR ADJUSTABLY POSITIONING A POWER TOOL OVER A WORK SURFACE

This application is a continuation of application Ser. No. 09/972,498, filed on Oct. 5, 2001 now U.S. Pat. No. 6,539,992.

BACKGROUND—FIELD OF INVENTION

This invention relates in general to routers and, more particularly, to an apparatus for adjustably positioning and moving a router and bit relative to a workpiece.

BACKGROUND—DESCRIPTION OF PRIOR ART

The router is among the most versatile of woodworking tools. When properly guided or fixtured is can be used to cut rabbets, dados, mortises, tenons and perform a variety of other wood shaping operations. A number of guides and fixtures are available commercially or can be shop or custom made to accomplish these tasks. Each operates generally independently of the others and can require considerable time to set up and adjust. Additionally, these fixtures provide a limited range of motion and limited amount of adjustment of the position of the cutting tool. Inventors have created devices in an effort to overcome these shortcomings. U.S. Pat. No. 3,923,086 to Spohn (1975) discloses an adjustable radial arm apparatus for use with a router. Likewise U.S. Pat. No. 5,287,900 to Falco (1994) discloses a radial arm router table. Both of these inventions suffer from the disadvantage of having a rigid and fixed radial arm extending over the work surface, thus diminishing the operator's field of view. Further, the fixed radial arm hinders access to the router for changing or servicing the bit or making adjustments.

SUMMARY OF THE INVENTION

It is the object of this invention to provide an improved mechanism to accurately and repeatably position or move a router and corresponding bit to perform a variety of wood shaping operations. It is a further object of this invention to provide a radial arm mechanism that provides and unobstructed view of the workpiece and unobstructed access to the router and bit.

DRAWING FIGURES

In the drawings, closely related figures have the same number but different alphabetic suffixes.

DESCRIPTION OF THE PREFERRED EMBODIMENT

Figure 1:
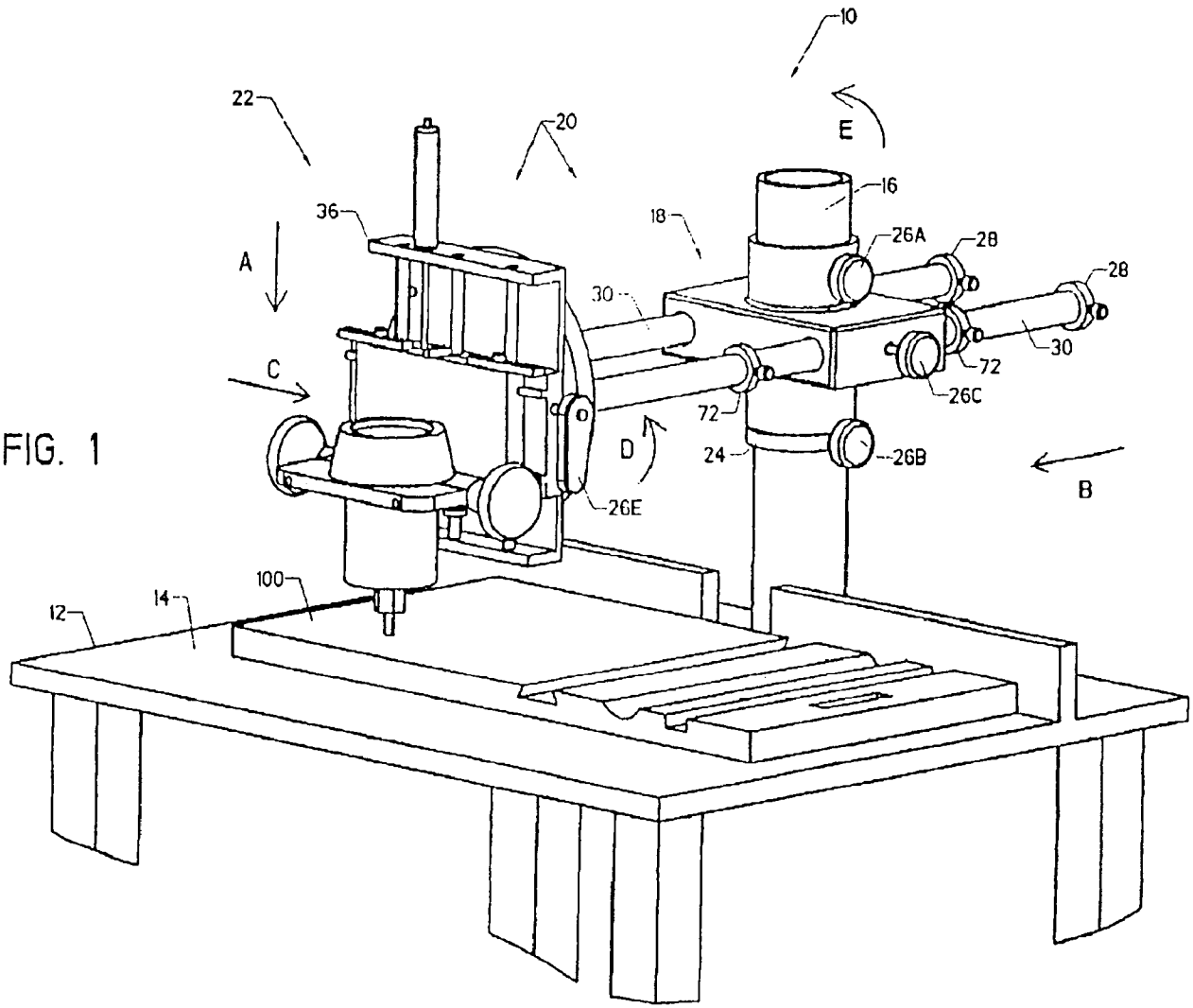
FIG. 1 is a front perspective view of the radial overarm router constructed in accordance with the present invention, the machine base of which is shown in fragment.
Figure 2:
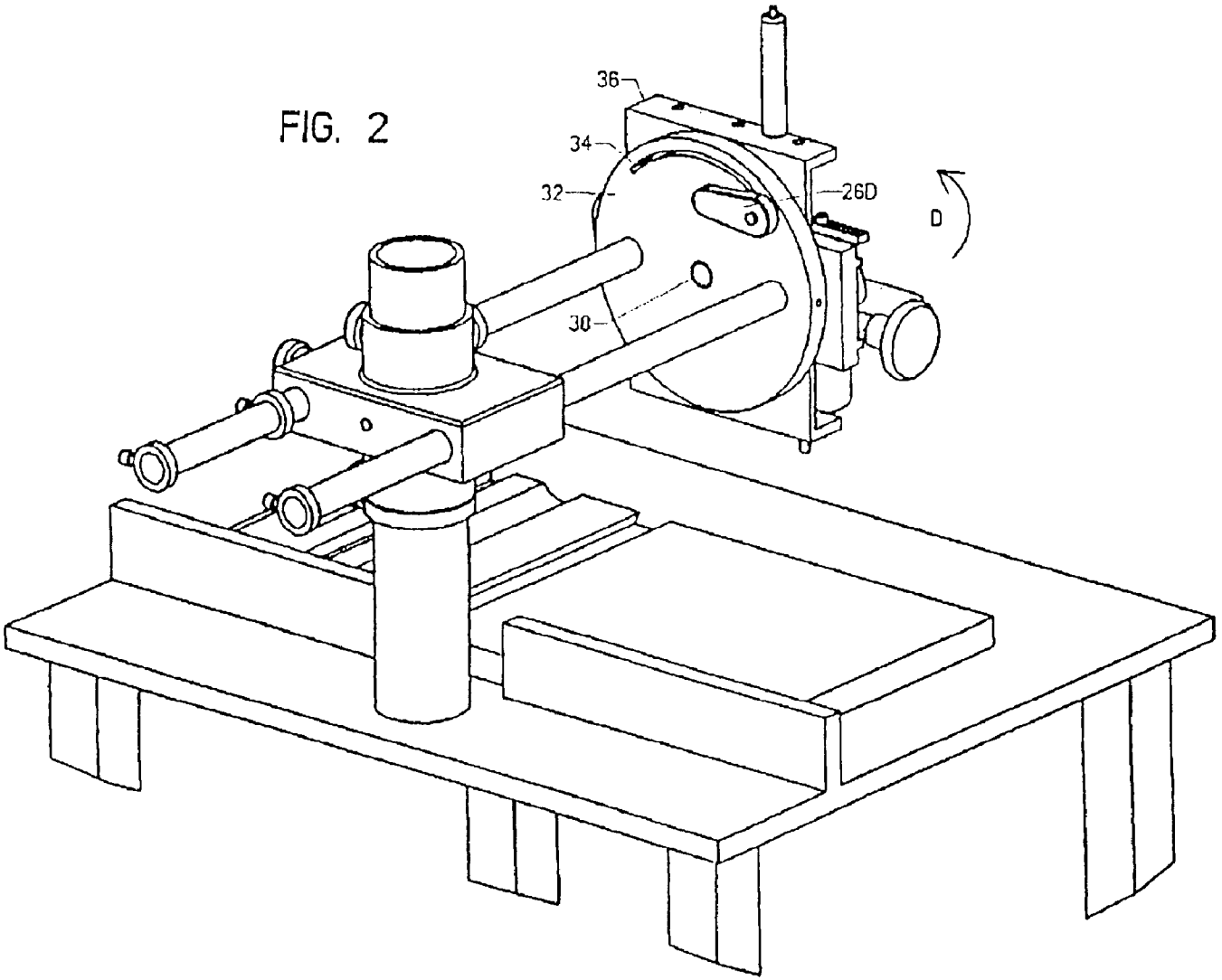
FIG. 2 is a rear perspective view of the slide assembly of the present invention.
Figure 3:
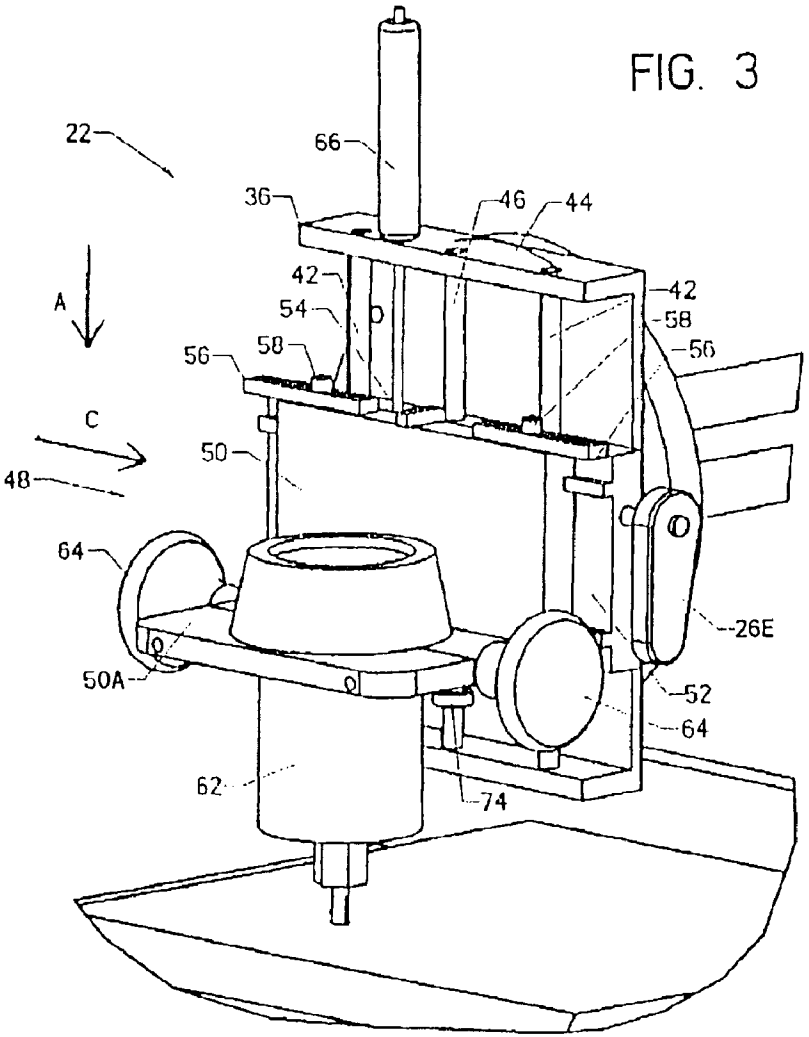
FIG. 3 is a detailed front perspective view of the carriage assembly.

With reference to the drawings, the apparatus is generally indicated by reference numeral 10. Apparatus 10 comprises a machine base 12, a work surface 14, a vertically disposed cylindrical column 16, a bearing house 18, a slide assembly 20, and a carriage subassembly 22. Bearing housing 18 is disposed slidably and pivotably to the vertical column 16. A locking knob 26A may be engaged to prevent rotation of bearing housing 18 about column 16. The axial position of bearing housing 18 on column 16 is maintained by abutment to a column stop 24. Column stop 24 is slidably and adjustably disposed on column 16 and selectively secured by a locking knob 26B.

Bearing housing 18 serves as a collar mounted on the cylindrical column 16, permitting linear movement along the axis of the column and rotational movement about the axis of the column 16. Extending through bearing housing 18 are one or more forward-to-aft directed linear guide members or rods 30. The bearing housing 18 includes means to allow for manually linearly sliding the rods 30 relative to the housing or collar 18 and perpendicular to column 16. These means may be provided by standard bearings of sleeves well known in industry. Adjustable stop collars 72 may be engaged forward and aft of the housing or collar 18 to selectively limit linear motion of rods 30. Further, a locking knob 26C may be engaged to prevent linear motion of rods 30 and subsequently slide assembly 20. Carriage subassembly 22 is disposed at forward end of rods 30. Stop collars 28 are fixed to aft end of rods. A mounting plate 32 is disposed perpendicular to ends of rods 30. Mounting plate 32 includes an arc shaped slot 34. A locking knob 26D passes through 34 and secures to a plate having a "C"-shaped cross-section, including first and second parallel legs and a web interconnecting the legs, frequently referred to herein as a "C" plate 36. "C" plate 36 is pivotably disposed to mounting plate 32 by means of a pin 38. Locking knob 26D may be engaged to prevent rotation of "C" plate 36 and subsequently carriage subassembly 22 about pin 38.

Further, "C" plate 36 includes linear guide members or rods 42 perpendicularly disposed to surface 44 and parallel and subsequently apart from each other. The guide members or rods 42 extend between the horizontal legs of the "C" plate and have longitudinal axes lying in a plane substantially perpendicular to the axes of the forward-to-aft rods 30. The "C" plate 36 further includes a threaded rod 46 disposed parallel to rods 42. The carriage subassembly 22 further includes a front bearing 48 slidably disposed on rods 42. Threaded rod 46 passes through front bearing housing 48. Locking knob 26E may be engaged to prevent linear motion of front bearing housing 48 relative to "C" plate 36. Front bearing housing 48 is comprised of a front plate 50 and an aft plate 52 wherein front plate 50 is slidably disposed to aft plate 52.

Front bearing housing 48 further includes stops 56 with securing means, for example screws 58, and a tab 54 disposed above and flush with top surface of aft plate 52 and between stops 56. Stops 56 are slidably and adjustable disposed to front plate 50 by screws 58. Front plate 50 further includes a horizontal member 50A and knobs or handles 64 mounted on opposing sides of horizontal member 50A of front plate 50. Front plate 50 further includes a means to accept and secure a router 62, for example a hole with a tensioning screw.

A spring device 66 is disposed to "C" plate 36 and is biased to urge front bearing housing 48 to the top of the "C" plate. A stop nut 74 is threaded onto threaded rod 46 below front bearing housing 48.

OPERATION

Referring now again to the figures, the apparatus 10 operates as follows: A workpiece 100 is placed on and secured to work surface 14. Means of securing the workpiece is not part of this invention and is therefore not detailed. The operator grasps and controls the apparatus by handles 64. By releasing locking knob 26E and providing a downward force in the direction of arrow A, plunge type cuts can be made in the workpiece. Depth of plunge cuts are controlled by adjusting stop nut 74 on threaded rod 46. Locking knob 26E may be re-engaged at any time to maintain the plunge cut at the desired depth. Additionally, by releasing knob 26C and providing force in the direction of arrow B, grooves, slots, dados, or rabbets may be cut into the workpiece. The amount of travel in the direction of arrow B may be controlled by adjusting and securing stops 72 on rods 30. Stopped dados and similar cuts may be made by this means. The width of the grooves or slots in the direction of arrow C is controlled by adjusting stops 56 which allows for transverse motion of the router 62 relative to front bearing housing 48. It is easily seen that combination of the above operation allows for easily creating mortises to receive tenons. Following plunge type cuts, spring device 66 serves to return front bearing housing 48 and subsequently router 62 to the starting or raised position. Carriage subassembly 22 may be rotated up to 90 degrees in direction of arrow D by releasing locking knob 26*d* and applying rotational force in the direction of arrow D. Carriage subassembly 22 may be secured with locking knob 26D at any included angle in order to perform the above said operations at an angle to the workpiece other that 90 degrees. It can easily be seen that locking the carriage subassembly 22 in the horizontal position provides for easy access for bit changes. Locking knob 26A may be disengaged in order to rotate slide assembly 20 in direction of arrow E about column 16. This allows for positioning the router to make the above cuts at additional angles to the workpiece. This configuration may also be use to make circular or arc cuts in the workpiece by rotating the slide assembly in the direction of arrow E during a cutting operation.

What is claimed is:

1. An apparatus for adjustably positioning a router over a work surface, comprising: a base defining said work surface; a first support structure attached to said base; a second support structure movably coupled to said first support structure, said second support structure extending over said work surface; a mount secured to said second support structure so as to be positioned over said work surface; and a router support assembly including a first support portion and a second support portion, said first support portion being pivotally attached to said mount, wherein said second support portion is linearly movable in relation to said first support portion between a first position and a second position, and wherein said second support portion is spring biased in relation to said first support portion toward said first position.

2. The apparatus of claim 1, wherein: said first support structure is vertically disposed, and said second support structure is horizontally disposed.

3. The apparatus of claim 1, wherein: said first support structure includes a cylindrical column attached to said base, and said second support structure includes a pair of guide rods movably coupled to said cylindrical column.

4. The apparatus of claim 3, wherein said second support structure further includes a rear bearing housing having: a first opening defined therein through which said cylindrical column extends, a second opening defined therein through which a first of said pair of guide rods extends, and a third opening defined therein through which a second of said pair of guide rods extends.

5. The apparatus of claim 1, wherein: said first support portion of said router support assembly includes a first vertically oriented plate pivotally attached to said mount, said second support portion of said router support assembly includes a front housing that is linearly movable in relation to said first vertically oriented plate.

6. The apparatus of claim 5, wherein: said front housing includes a second vertically oriented plate and a horizontally disposed support plate secured thereto, and said horizontally disposed support plate has defined therein an opening configured to receive said router.

7. The apparatus of claim 6, wherein said horizontally disposed support plate has a handle attached thereto which is configured to be grasped by an operator.

8. The apparatus of claim 5, wherein: said first vertically oriented plate includes a linearly extending guide member, and said front housing is slidably disposed on said guide member.

9. An apparatus for adjustably positioning a power tool over a work surface, comprising: a first support structure oriented vertically; a second support structure movably coupled to said first support structure, said second support structure including a pair of parallel forward-to-aft guide rods; a mount secured to said second support structure so as to be positioned over said work surface; said mount including a first vertical plate fixed to said forward-to-aft guide rods; a second plate having a C-shaped cross-section including first and second parallel legs and a web interconnecting said legs, said web being parallel to and rotatably mounted on said first vertical plate; at least one guide member extending between said legs and defining a linear direction; and a power tool support assembly mounted for movement in said linear direction relative to said second plate along said guide member.

10. An apparatus for adjustably positioning a power tool over a work surface, comprising: a first support structure; a second support structure movably coupled to said first support structure; a mount secured to said second support structure so as to be positioned over said work surface; and a power tool support assembly including a first support portion and a second support portion, said first support portion being movably attached to said mount so as to provide a first manner of adjustment between said power tool support assembly and said mount, wherein said second support portion is movable in relation to said first support portion between a first position and a second position so as to provide a second manner of adjustment between said power tool support assembly and said mount, wherein said second support portion is spring biased in relation to said first support portion toward said first position.

11. The apparatus of claim 9, wherein: said power tool support assembly includes a power tool receiving structure.

12. The apparatus of claim 9, wherein: said first support structure includes a cylindrical column.

13. The apparatus of claim 12, wherein said second support structure further includes a rear bearing housing having: a first opening defined therein through which said cylindrical column extends, a second opening defined therein through which a first of said pair of guide rods extends, and a third opening defined therein through which a second of said pair of guide rods extends.

14. An apparatus for adjustably positioning a power tool over a work surface, comprising: a first support structure; a second support structure movably coupled to said first support structure; a mount secured to said second support structure so as to be positioned over said work surface; and a power tool support assembly including a first support portion including a first vertically oriented plate rotatably attached to said mount, and a second support portion, including a front housing that is linearly movable in relation to said first vertically oriented plate, said first support portion being movably attached to said mount so as to provide a first manner of adjustment between said power tool support assembly and said mount, wherein said second support portion is movable in relation to said first support portion between a first position and a second position so as to provide a second manner of adjustment between said power tool support assembly and said mount, wherein: said first vertically oriented plate includes a linearly extending guide member, and said front housing is slidably disposed on said guide member.

15. An apparatus for adjustably positioning a power tool over a work surface, comprising: a base defining said work surface; a vertically disposed support member attached to said base; a horizontally disposed support structure including at least two parallel guide rods being movable in relation to said vertically disposed support structure (i) in a pivotal manner about an axis of said vertically disposed support member, and (ii) in a linear manner perpendicular to said axis of said vertically disposed support member; and a power tool support assembly having a power tool receiving structure positioned over said work surface, wherein said power tool receiving structure includes a first plate secured to said guide rods, a second plate pivotably mounted relative to said first plate, a linear guide member secured to said second plate, and a power tool receiving structure mounted for linear movement along said linear guide member.

16. The apparatus of claim 15, wherein: said power tool receiving structure is movable in said linear manner between a first position and a second position, and wherein said power tool receiving structure is spring biased toward said first position.

17. The apparatus of claim 15, wherein: said vertically disposed support member includes a cylindrical column, and said horizontally disposed support structure includes said guide rods movably coupled to said cylindrical column.

18. The apparatus of claim 17, wherein said horizontally disposed support structure further includes a rear bearing housing having: a first opening defined therein through which said cylindrical column extends, a second opening defined therein through which a first of said pair of guide rods extends, and a third opening defined therein through which a second of said pair of guide rods extends.

19. The apparatus of claim 15, wherein: said power tool receiving structure includes a front housing including a third vertically oriented plate and a horizontally disposed support plate secured thereto, and said horizontally disposed support plate includes said power tool receiving structure which defines an opening configured to receive said power tool.

20. The apparatus of claim 19, wherein said horizontally disposed support plate has a handle attached thereto which is configured to be grasped by an operator.

21. The apparatus of claim 19, wherein: said third vertically oriented plate is slidably disposed on said guide member.

22. The apparatus of claim 15, wherein said linear guide member defines first and second directions, and further comprising a spring for biasing said power tool receiving structure in said first direction.

* * * * *